US009786234B2

(12) United States Patent
Lin et al.

(10) Patent No.: US 9,786,234 B2
(45) Date of Patent: Oct. 10, 2017

(54) DRIVING MODULE HAVING LOW CHARGING/DISCHARGING POWER CONSUMPTION AND DRIVING DEVICE THEREOF

(71) Applicant: NOVATEK Microelectronics Corp., Hsin-Chu (TW)

(72) Inventors: Chieh-An Lin, Taipei (TW); Pang-Chen Hung, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 437 days.

(21) Appl. No.: 14/494,572

(22) Filed: Sep. 23, 2014

(65) Prior Publication Data

US 2016/0086556 A1 Mar. 24, 2016

(51) Int. Cl.
*G09G 5/00* (2006.01)
*G09G 3/36* (2006.01)

(52) U.S. Cl.
CPC ..... *G09G 3/3614* (2013.01); *G09G 3/3688* (2013.01); *G09G 2310/0291* (2013.01)

(58) Field of Classification Search
CPC ..... G09G 3/3614; G09G 2310/0291; G09G 3/3688
USPC ..... 345/209
See application file for complete search history.

(56) References Cited

U.S. PATENT DOCUMENTS

2009/0201237 A1* 8/2009 Nishimura ..... H03F 3/45183 345/87
2009/0244056 A1* 10/2009 Tsuchi ..... G09G 3/3688 345/214
2010/0134462 A1* 6/2010 Kim ..... G09G 3/3688 345/211
2010/0265273 A1* 10/2010 Nishimura ..... G09G 3/3688 345/690
2011/0199360 A1* 8/2011 Fujiwara ..... G09G 3/3688 345/211
2012/0075277 A1* 3/2012 Hirayama ..... G09G 3/3614 345/209

* cited by examiner

*Primary Examiner* — Jonathan Blancha
(74) *Attorney, Agent, or Firm* — Winston Hsu

(57) ABSTRACT

A driving module for a driving device of a display system includes a control unit, for generating a control signal according to a polarity signal indicating whether the driving device performs a polarity inversion; a first driving unit, coupled to the control unit, a first voltage source and a second voltage source, for generating a positive output voltage at a first output end according to a first display voltage and charging the first output end via the second voltage source according to the control signal; and a second driving unit, coupled to the control unit, the second voltage source and a third voltage source, for generating a negative output voltage at a second output end according to a second display voltage and discharging the second output end via the second voltage source according to the control signal.

22 Claims, 8 Drawing Sheets

DRIVING MODULE HAVING LOW CHARGING/DISCHARGING POWER CONSUMPTION AND DRIVING DEVICE THEREOF

BACKGROUND OF THE INVENTION

1. Field of the Invention

The present invention relates to a driving module and driving device thereof, and more particularly, to a driving module capable of reducing voltage differences of charging and discharging operations in the driving module and driving device thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, especially in the large-size LCD family. A driving system installed in the LCD, includes a timing controller, source drivers and gate drivers. The source and gate drivers respectively control data lines and scan lines, which intersect to form a cell matrix. Each intersection is a cell including crystal display molecules and a TFT.

In the driving system (e.g. a driving integrated circuit (IC)), the gate drivers are responsible for transmitting scan signals to gates of TFTs to turn on the TFTs on the panel. The source drivers are responsible for converting digital image data, sent by the timing controller, into analog voltage signals and outputting the voltage signals to sources of the TFTs. When the TFT receives the voltage signals, a corresponding liquid crystal molecule has a terminal whose voltage changes to equalize the drain voltage of the TFT, and thereby changes its own twist angle. The rate that light penetrates the liquid crystal molecule is changed accordingly, and thus different colors can be displayed on the panel.

Due to the heavy loadings of the TFTs and the liquid crystal molecules in the panel, the driving system consumes significant power when repeating charging and discharging the TFTs and the liquid crystal molecules, resulting in the violent temperature increase of the driving system and the reliability decrease of the driving system. Thus, how to reduce the power consuming on driving the panel becomes a topic to be discussed.

SUMMARY OF THE INVENTION

In order to solve the above problem, the present invention provides a driving module capable of reducing voltage differences of charging and discharging operations in the driving modules for reducing the power consumption of the driving module and driving device thereof.

The present invention discloses a driving module for a driving device of a display system, comprising a control unit, for generating a control signal according to a polarity signal indicating whether the driving device performs a polarity inversion; a first driving unit, coupled to the control unit, a first voltage source and a second voltage source, for generating a positive output voltage at a first output end according to a first display voltage and charging the first output end via the second voltage source according to the control signal; and a second driving unit, coupled to the control unit, the second voltage source and a third voltage source, for generating a negative output voltage at a second output end according to a second display voltage and discharging the second output end via the second voltage source according to the control signal.

The present invention further discloses a driving device for a display system, comprising a plurality of display component, drove by a plurality of driving signals; and a plurality of driving modules, for generating the plurality of the driving signals, wherein each of the driving modules comprises a control unit, for generating a control signal according to a polarity signal indicating whether the driving device performs a polarity inversion; a first driving unit, coupled to the control unit, a first voltage source and a second voltage source, for generating a positive output voltage at a first output end according to a first display voltage and charging the first output end via the second voltage source according to the control signal; and a second driving unit, coupled to the control unit, the second voltage source and a third voltage source, for generating a negative output voltage at a second output end according to a second display voltage and discharging the second output end via the second voltage source according to the control signal.

The present invention further discloses a driving module for a driving device of a display system, comprising a first amplifier, comprising a first positive input end coupled to a first display voltage, a first negative input end coupled to a first output end, a first positive output end and a first negative output end, for generating a first positive control signal at the first positive output end and a first negative control signal at the first negative output end according to the first display voltage; a second amplifier, comprising a second positive input end coupled to a second display voltage, a second negative input end coupled to a second output end, a second positive output end and a second negative output end, for generating a second positive control signal at the second positive output end and a second negative control signal at the second negative output end according to the second display voltage; a first switch, coupled to the first positive output end of the first amplifier, a first voltage source and a first output end for controlling the connection between the first voltage source and the first output end according to the first positive control signal; a second switch, coupled to the first negative output end of the first amplifier, a second voltage source and the first output end for controlling the connection between the second voltage source and the first output end according to the first negative control signal; a third switch, coupled to the second positive output end of the second amplifier, the second voltage source and the second output end for controlling the connection between a second voltage source and the second output end according to the second positive control signal; a fourth switch, coupled to the second amplifier, a third voltage source and the second output end for controlling the connection between the third voltage source and the second output end according to the second negative control signal; and a control unit, for adjusting voltages of the first voltage source, the second voltage source and the third voltage source according to a charging-discharging signal indicating timings that the first voltage source charging the first output end via the first switch, the second voltage source discharging the first output end via the second switch, the second voltage source charging the second output end via the third switch and the third voltage source discharging the second output end via the fourth switch.

The present invention further discloses a driving device for a display system, comprising a plurality of display components, drove by a plurality of driving signals; and a plurality of driving modules, for generating the plurality of driving signals, wherein each of the plurality of driving modules comprises a first amplifier, comprising a first positive input end coupled to a first display voltage, a first negative input end coupled to a first output end, a first positive output end and a first negative output end, for generating a first positive control signal at the first positive output end and a first negative control signal at the first negative output end according to the first display voltage; a second amplifier, comprising a second positive input end coupled to a second display voltage, a second negative input end coupled to a second output end, a second positive output end and a second negative output end, for generating a second positive control signal at the second positive output end and a second negative control signal at the second negative output end according to the second display voltage; a first switch, coupled to the first positive output end of the first amplifier, a first voltage source and a first output end for controlling the connection between the first voltage source and the first output end according to the first positive control signal; a second switch, coupled to the first negative output end of the first amplifier, a second voltage source and the first output end for controlling the connection between the second voltage source and the first output end according to the first negative control signal; a third switch, coupled to the second positive output end of the second amplifier, the second voltage source and the second output end for controlling the connection between a second voltage source and the second output end according to the second positive control signal; a fourth switch, coupled to the second amplifier, a third voltage source and the second output end for controlling the connection between the third voltage source and the second output end according to the second negative control signal; and a control unit, for adjusting voltages of the first voltage source, the second voltage source and the third voltage source according to a charging-discharging signal indicating timings that the first voltage source charging the first output end via the first switch, the second voltage source discharging the first output end via the second switch, the second voltage source charging the second output end via the third switch and the third voltage source discharging the second output end via the fourth switch.

These and other objectives of the present invention will no doubt become obvious to those of ordinary skill in the art after reading the following detailed description of the preferred embodiment that is illustrated in the various figures and drawings.

DETAILED DESCRIPTION

In the following embodiments of the present invention, driving modules for a driving device of a display system are disclosed. The power consumption of the driving modules are significantly decreased via reducing the voltage differences of charging and discharging operations in the driving modules when performing the polarity inversion, such that the temperature of the driving device would not increase violently and the reliability of the driving device can be improved. The present invention is particularly shown and described with respect to at least one exemplary embodiment accompanied by drawings. Words utilized for describing connections between two components such as 'couple' and 'connect' should not be taken as limiting a connection between the two components to be directly coupling or indirectly coupling.

Figure 1:
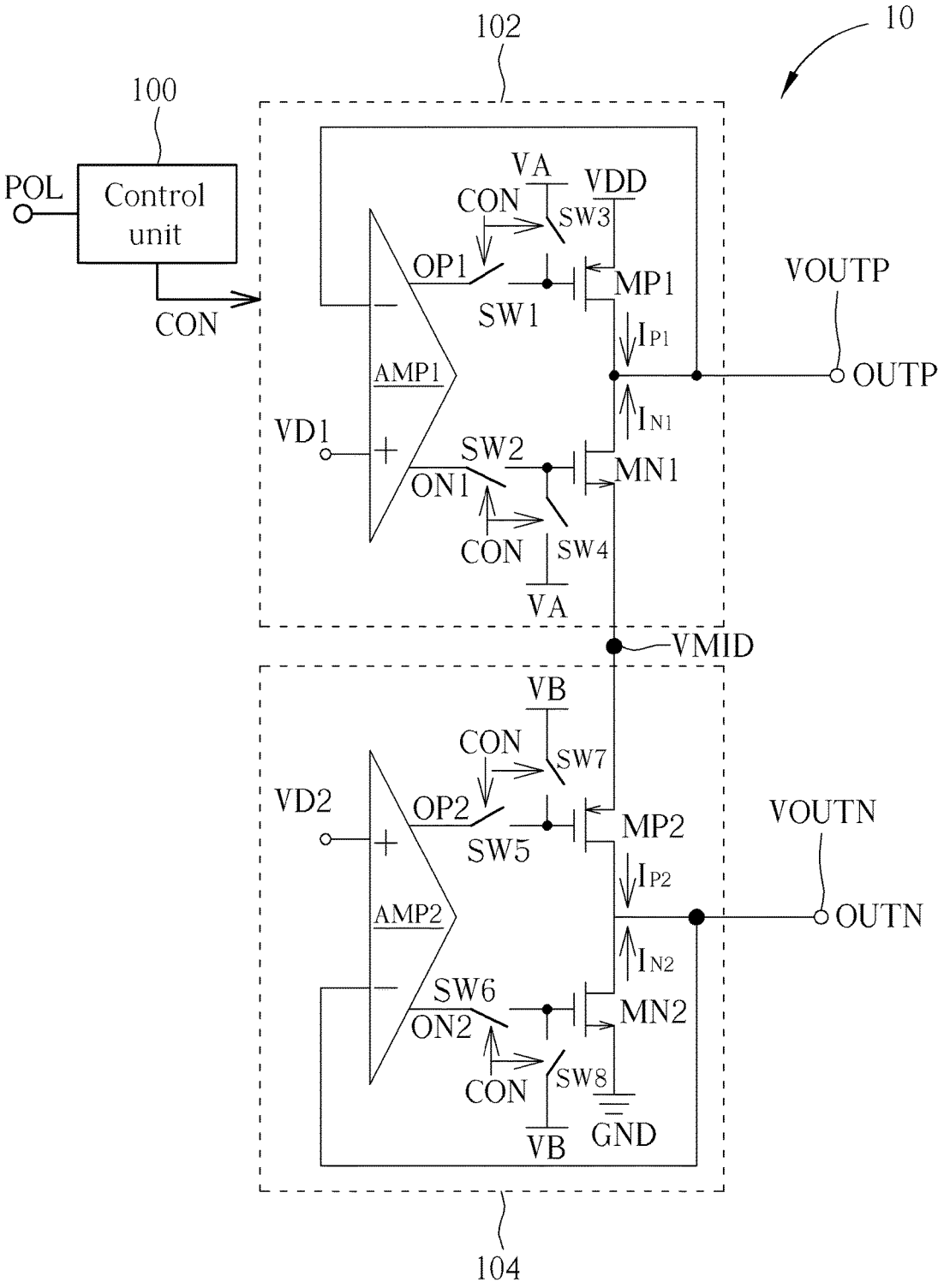
FIG. 1 is a schematic diagram of a driving module according to an embodiment of the present invention.

Please refer to FIG. 1, which is a schematic diagram of a driving module 10 according to an embodiment of the present invention. The driving module 10 is utilized in a driving device (e.g. a driver integrated circuit (IC)) of a display system (e.g. a liquid-crystal display (LCD)) for generating output voltages VOUTP and VOUTN used for driving display components, such as liquid crystal molecules, of the display system. For example, the driving module 10 may be a source driver and the driving device may comprise a plurality of driving modules 10 for generating signals for driving a plurality of data lines of the display system. As shown in FIG. 1, the driving module 10 comprises a control unit 100 and driving units 102 and 104. The control unit 100 is utilized for generating a control signal CON according to a polarity signal POL, wherein the polarity signal POL indicates whether the driving device performs a polarity inversion. The driving unit 102 is coupled to the control unit 100 and voltage sources VDD and VMID for generating the output voltage VOUTP at an output end VOUTP according to a display voltage VD1 and charging the output end VOUTP via the voltage source VMID according to the control signal CON. Similarly, the driving unit 104 is coupled to the control unit 100 and the voltage source VMID and a ground GND for generating the output voltage VOUTN at an output end VOUTN according to a display voltage VD2 and discharging the output end VOUTN via the voltage source VMID according to the control signal CON. Via charging the output end OUTP and discharging the output end OUTN when the polarity signal POL indicates that the display system performs the polarity inversion, the voltage differences of the transistors in the driving units 102 and 104 while performing the polarity inversion can be reduced, such that the power consumption of the driving module 10 is decreased.

In details, the voltage sources VDD and VMID may be provided by voltage regulators, such as buck converters, boost converters or low-voltage drop regulators, and is not limited herein. The voltage of the voltage source VDD is greater than that of the voltage source VMID and the voltage of the voltage source VMID is greater than that of the ground GND (i.e. VDD>VMID>GND). For example, the voltage of the voltage source VMID may be the average of the voltages of the voltage source VDD and ground GND $$\left(\text{i.e. } VMID = \frac{VDD + GND}{2}\right).$$

The driving unit 102 comprises an amplifier AMP1, switches SW1-SW4, and transistors MP1 and MN1. The amplifier AMP1 comprises a positive input end INP1 for receiving the display voltage VD1, a negative input end INN1 coupled to the output end OUTP, and output ends OP1 and ON1. The switch SW1 is coupled between the output end OP1 and the gate of the transistor OP1, the switch SW2 is coupled between the output end ON1 and the gate of the transistor MN1, the switch SW3 is coupled between the output end OP1 and a voltage source VA, and the switch SW4 is coupled between the output end ON1 and the voltage source VA. The source and the drain of the transistor MP1 are coupled to the voltage source VDD and the output end OUTP, respectively, and the source and the drain of the transistor MN1 are coupled to the voltage source VMID and the output end OUTP, respectively. Note that, the voltage difference between the voltage sources VDD and VA is capable of making the transistor MP1 to turn into cut-off state and the voltage difference between the voltage source VA and ground GND is capable of conducting the transistor MN1. For example, the voltage of the voltage source VA may be that of the voltage source VDD.

Similarly, the driving unit 104 comprises an amplifier AMP2, switches SW5-SW8, and transistors MP2 and MN2. The amplifier AMP2 comprises a positive input end INP2 for receiving the display voltage VD2, a negative input end INN2 coupled to the output end OUTN, and output ends OP2 and ON2. The switch SW5 is coupled between the output end OP2 and the gate of the transistor OP2, the switch SW6 is coupled between the output end ON2 and the gate of the transistor MN2, the switch SW7 is coupled between the output end OP2 and a voltage source VB, and the switch SW8 is coupled between the output end ON2 and the voltage source VB. The source and the drain of the transistor MP2 are coupled to the voltage source VMID and the output end OUTN, respectively, and the source and the drain of the transistor MN2 are coupled to the ground GND and the output end OUTN, respectively. Note that, the voltage difference between the voltage sources VMID and VB is capable of conducting the transistor MP1 and the voltage difference between the voltage source VB and ground GND is capable of making the transistor MN1 to turning into cut-off state. For example, the voltage of the voltage source VB may be that of ground GND.

When the polarity signal POL indicates that the driving module 10 performs normal operations, the control unit 100 generates the control signal CON to conduct the switches SW1, SW2, SW5 and SW6 and to disconnect the switches SW3, SW4, SW7 and SW8. The amplifier AMP1 therefore outputs appropriate signals UP1 and DN1 at the output ends OP1 and ON1, respectively, to control the output stage consisted of the transistors MP1 and MN1 to charge the output end OUTP via a current $I_{P1}$ from the voltage source VDD or to discharge the output end OUTP via a current $I_{N1}$ to the voltage source VMID, so as to generate the output voltage VOUTP according to the display voltage VD1. In such a condition, an instant power consumption $P_+$ and an average power consumption $P_{AVG+}$ within a period T of the output stage consisted of the transistors MP1 and MN1 can be expressed as the following equations:

$$P_+ = V_{DSP1} \times I_{P1} + V_{DSN1} \times I_{N1} \tag{1}$$

$$P_{AVG+} = \frac{1}{T}\int_T (V_{DSP1} \times I_{P1} + V_{DSN1} \times I_{N1})dt \tag{2}$$

wherein the voltage $V_{DSP1}$ is the voltage across the drain and the source of the transistor MP1 when charging the output end OUTP and the voltage $V_{DSN1}$ is the voltage across the drain and the source of the transistor MN1 when discharging the output end OUTP.

Similarly, the amplifier AMP2 outputs appropriate signals UP2 and DN2 at the output ends OP2 and ON2, respectively, to control the output stage consisted of the transistors MP2 and MN2 to charge the output end OUTN via a current $I_{P2}$ from the voltage source VMID or to discharge the output end OUTN via a current $I_{N2}$ to the ground GND, so as to generate the output voltage VOUTN according to the display voltage VD2. An instant power consumption $P_-$ and an average power consumption $P_{AVG-}$ within the period T of the output stage consisted of the transistors MP2 and MN2 can be expressed as the following equations:

$$P_- = V_{DSP2} \times I_{P2} + V_{DSN2} \times I_{N2} \tag{3}$$

$$P_{AVG-} = \frac{1}{T}\int_T (V_{DSP2} \times I_{P2} + V_{DSN2} \times I_{N2})dt \tag{4}$$

wherein the voltage $V_{DSP2}$ is the voltage across the drain and the source of the transistor MP2 when charging the output end OUTN and the voltage $V_{DSN2}$ is the voltage across the drain and the source of the transistor MN2 when discharging the output end OUTN. As can be seen from the equations (1)-(4), the average power consumption of the driving module 10 can be reduced if the voltages $V_{DSP1}$, $V_{DSN1}$, $V_{DSP2}$, and $V_{DSN2}$ become smaller.

When the polarity signal POL indicates that the display system is going to perform the polarity inversion, the output voltage VOUTP may need to be adjusted from ground voltage to a voltage greater than the voltage of the voltage source VMID and the output voltage VOUTN may need to be adjusted from the voltage of the voltage source VDD to a voltage smaller than the voltage of the source VMID. Generally, the output end OUTP is charged via the transistor MP1 and the output end OUTN is discharged via the transistor MN2. In such a condition, an average power consumption $P_{AVG}$ of the output stages consisted of the transistors MP1, MN1 and MP2, MN2 can be expressed as:

$$\begin{aligned} P_{AVG} = P_{AVG+} + P_{AVG-} &= \frac{1}{T}\int_T (P_+ + P_-)dt \\ &= \frac{1}{T}\int_T (V_{DSP1} \times I_{P1} + V_{DSN2} \times I_{N2})dt = \frac{1}{T}\int_T [VDD(I_{P1} + I_{N2})]dt \end{aligned} \tag{5}$$

In order to reduce the power consumption of the driving module 10, the control unit 100 generates the control signal CON for disconnecting the switches SW1, SW2, SW5 and SW6 and conducting the switches SW3, SW4, SW7 and SW8 for a certain period when the polarity signal POL indicates that the display system performs the polarity inversion in this embodiment. Within the certain period, the output end OUTP is charged via a current $I_{N1}'$ from the voltage source VMID and the output end OUTN is discharged via a current $I_{P2}'$ from the voltage source VMID. After the certain period, the output voltages VOUTP and VOUTN become the voltage of the voltage source VMID and the switches SW1, SW2, SW5 and SW6 are conducted and the switches SW3, SW4, SW7 and SW8 are disconnected according to the control signal CON. The output end OUTP changes to be charged via a current $I_{P1}'$ from the voltage source VDD and the output end OUTN changes to be discharged by a current $I_{N2}'$ from ground GND. An average power consumption $P_{AVG}'$ of the output stages consisted of the transistors MP1, MN1 and MP2, MN2 in this embodiment can be expressed as:

$$P'_{AVG} = P'_{AVG+} + P'_{AVG-} = \frac{1}{T}\int_T (P_+ + P_-)dt \tag{6}$$

$$= \frac{1}{T}\int_T (P_+ + P_-)dt = \frac{1}{T}\int_T [(V_{DSN1} \times I'_{N1} + V_{DSP1} \times I'_{P1}) + (V_{DSP2} \times I'_{P2} + V_{DSN2} \times I'_{N2})]dt$$

$$= \frac{1}{T}\int_T [VMID(I'_{P1} + I'_{N1} + I'_{P2} + I'_{N2})]dt$$

Assuming the times of charging and discharging the output ends OUTP and OUTN are constant and the charges in the driving module 10 obey the law of charges conservation, the current IP1 is equal to the sum of the currents $I_{P1}'$ and $I_{N1}'$ (i.e. $I_{P1}=I_{P1}'+I_{N1}'$) and the current IN2 is equal to the sum of the current $I_{P2}'$ and $I_{N2}'$ (i.e. $I_{N2}=I_{P2}'+I_{N2}'$). According to the equations (5) and (6), the average power consumption $P_{AVG}'$ is smaller than the average power consumption $P_{AVG}$ since the voltage of the voltage source VMID is smaller than that of the voltage source VDD. In other words, the voltage differences of charging the output end OUTP and discharging the output end OUTN is reduced (e.g. reduced from the voltage of the voltage source VDD to that of the voltage source VMID) in this embodiment, so as to decrease the average power consumption of the driving module 10.

Figure 2A:
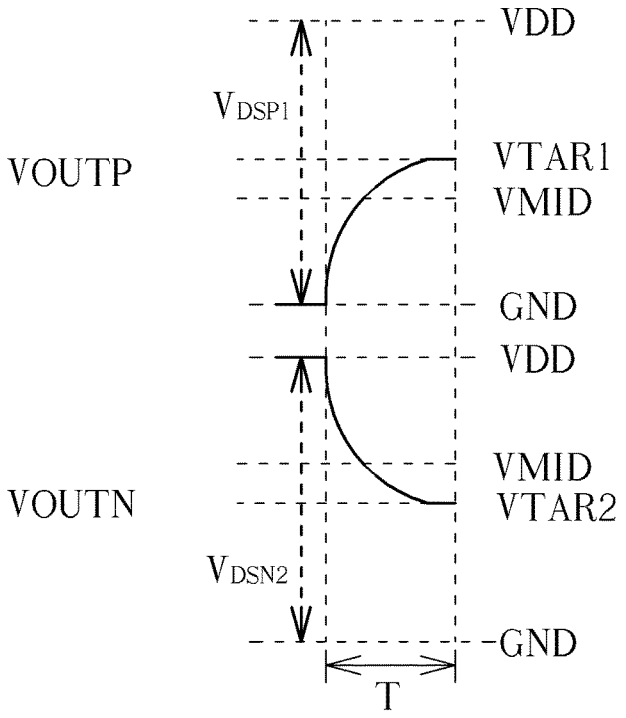
FIGS. 2A and 2B are timing diagrams of related signals when the driving module shown in FIG. 1 performs the polarity inversion.
Figure 2B:
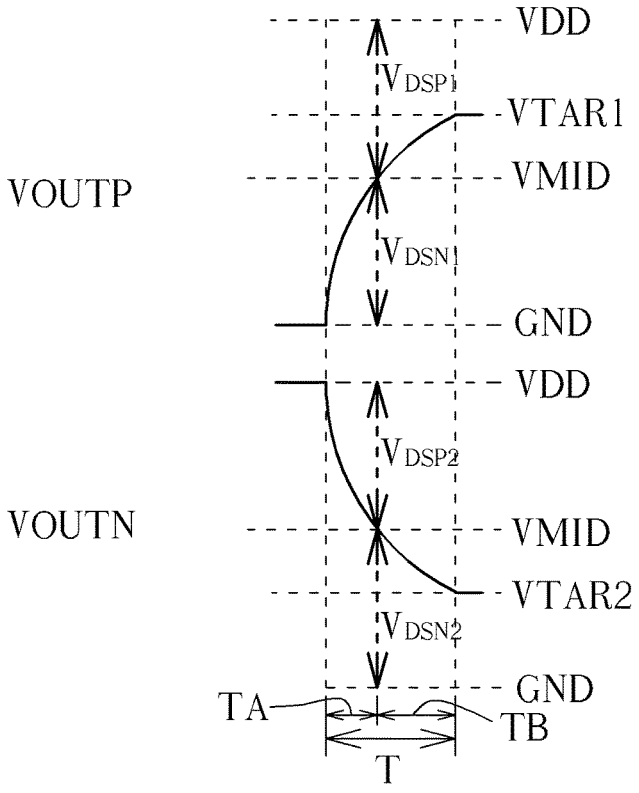

Please refer to FIGS. 2A and 2B, which are timing diagrams of related signals when the driving module 10 performs the polarity inversion. In FIG. 2A, the switches SW1, SW2, SW5 and SW6 are constantly conducted and the switches SW3, SW4, SW7 and SW8 are constantly disconnected when the display system performs the polarity inversion and the operations of the driving module 10 are similar to those of the source driver in the conventional art. When the polarity inversion is performed, the output voltage VOUTP is desired to be increased from the voltage of ground GND to a target voltage VTAR1, which is greater than the voltage of the voltage source VMID, and the output voltage VOUTN is desired to be decreased from the voltage of the voltage source VDD to a target voltage VTAR2, which is smaller than the voltage of the voltage source VMID, in the period T. In such a condition, the amplifier AMP1 would conduct the transistor MP1 and disconnect the transistor MN1 via the signals UP1 and DN1, to charge the output end OUTP via the current IP1 from the voltage source VDD and to increase the output voltage VOUTP to the target voltage VTAR1. Similarly, the amplifier AMP2 would disconnect the transistor MP2 and conduct the transistor MN2 via the signals UP2 and DN2, to discharge the output end OUTN via the current IN2 from ground GND and to decrease the output voltage VOUTN to the target voltage VTAR2. The voltage difference of charging the output end OUTP is the voltage difference between the voltage of the voltage source VDD and the output voltage VOUTP, and the voltage difference of discharging the output end OUTN is the voltage difference between the voltage of the ground GND and the output voltage VOUTN in the beginning.

In comparison, please refer to FIG. 2B, the switches SW1, SW2, SW5 and SW6 are disconnected and the switches SW3, SW4, SW7 and SW8 are conducted for the certain period when the display system performs the polarity inversion. As shown in FIG. 2B, since the output end OUTP is charged by the voltage source VMID within a period TA and is charged by the voltage source VDD within a period TB, the voltage difference of charging the output end OUTP within the period TA is reduced to be the voltage difference between the voltage of the voltage source VMID and the output voltage OUTP, and the voltage difference of charging the output end OUTP within the period TB is the voltage difference between the voltage of the voltage source VDD and the output voltage OUTP. Similarly, since the output end OUTN is discharged by the voltage source VMID within the period TA and is discharged by ground GND within the period TB, the voltage difference of discharging the output end OUTN within the period TA is the voltage difference between the voltage of the voltage source VMID and the output voltage VOUTN, and the voltage difference of discharging the output end OUTN within the period TB is the voltage difference between the voltage of ground GND and the output voltage VOUTN. Via disconnecting the switches SW1, SW2, SW5 and SW6 and conducting the switches SW3, SW4, SW7 and SW8 for the certain period (i.e. the period TA) when the display system performs the polarity inversion, the voltage difference of charging the output end OUTP and discharging the output end OUTN is reduced, so as to decrease the average power consumption of the driving module 10.

Figure 3:
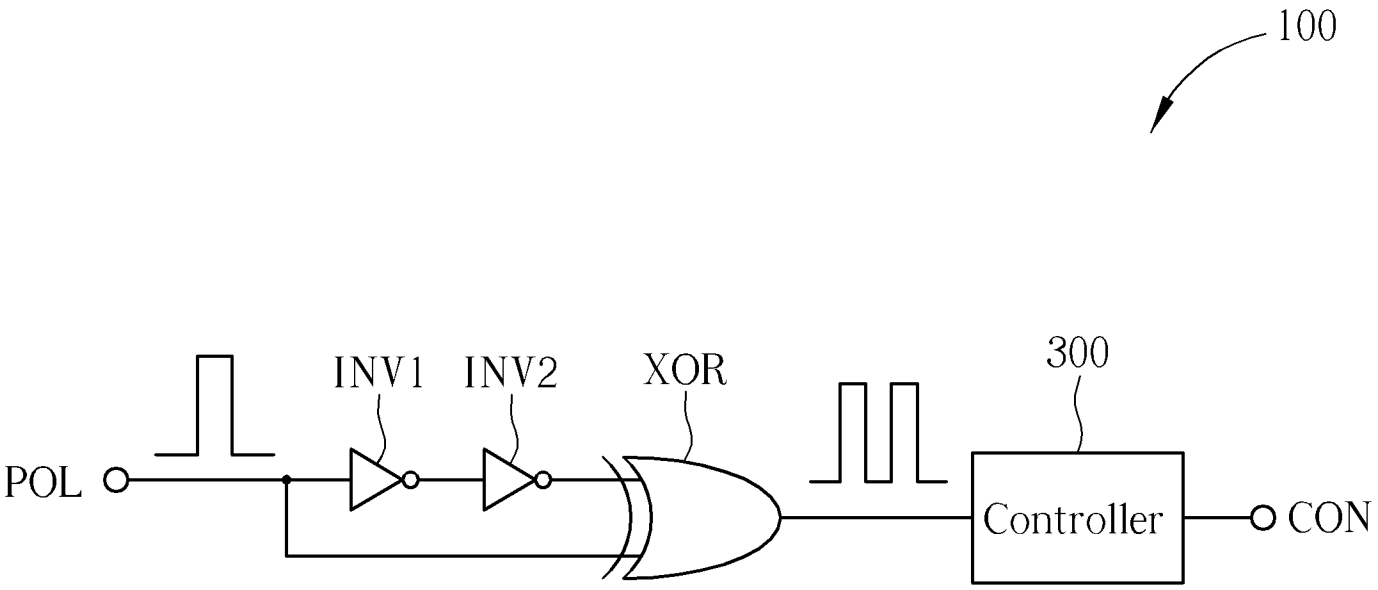
FIG. 3 is an exemplary embodiment of the control unit 100 shown in FIG. 1.

According to different applications and design concepts, the control unit 100, the driving units 102 and 104 may be realized in different ways. Please refer to FIG. 3, which is a schematic diagram of an exemplary embodiment of the control unit 100 shown in FIG. 1. As shown in FIG. 3, the control unit 100 comprises inverters INV1, INV2, an exclusive-or logic gate XOR and a controller 300. An input end of the inverter INV1 is coupled to the polarity signal POL and an output end of the inverter INV1 is coupled to the inverter INV2. An input end of the exclusive-or logic gate XOR is coupled to an output end of the inverter INV2, another input end of the exclusive-or logic gate XOR is coupled to the polarity signal POL and an output end of the exclusive-or logic gate XOR is coupled to the controller 300. When the polarity signal POL switches from a high-voltage level to a low-voltage level (i.e. from '1' to '0') or from the low-voltage level to the high-voltage level (i.e. from '0' to '1'), the display system performs the polarity inversion. Via the inverters INV1, INV2 and the exclusive-or logic gate XOR, the controller 300 receives pulses when the polarity signal POL is switched, so as to generate the corresponded control signal CON according to the pulses for disconnecting the switches SW1, SW2, SW5 and SW6 and conducting the switches SW3, SW4, SW7 and SW8 for the certain period when the display system performs the polarity inversion.

Figure 4:
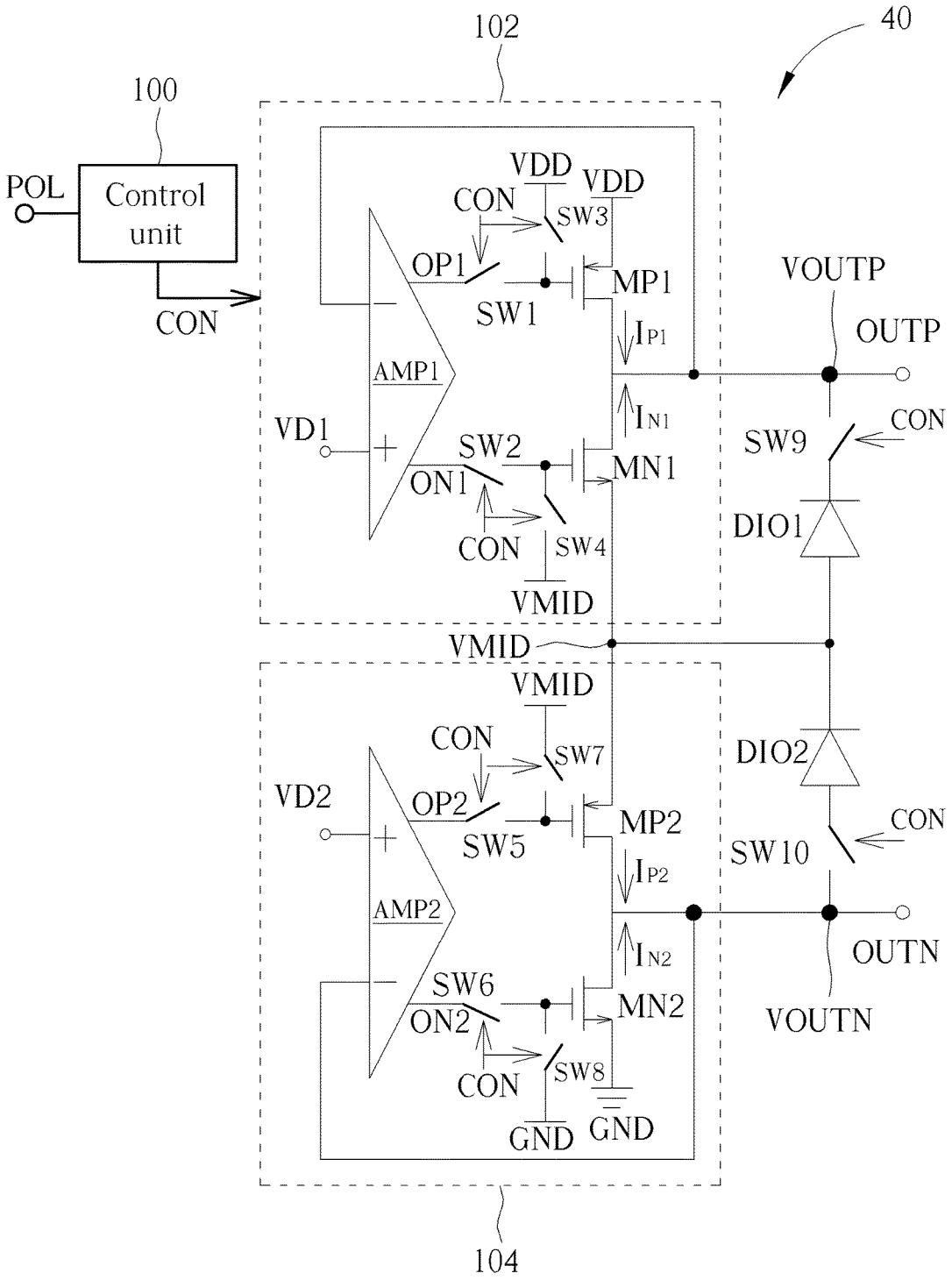
FIG. 4 is a schematic diagram of a driving module according to another embodiment of the present invention.

Please refer to FIG. 4, which is a schematic diagram of a driving module 40 according to an embodiment of the present invention. The driving module 40 is similar to the driving module 10 shown in FIG. 1; thus, the components and the signals with the similar functions use the same symbols. The driving module 40 is utilized in a driving device of a display system for generating the output voltages VOUTP and VOUTN used for driving display components, such as liquid crystal molecules, of the display system. For example, the driving module 40 may be a source driver and the driving device may comprise a plurality of driving modules 40 for generating signals for driving a plurality of data lines of the display system. Different from the driving module 10, the switch SW3 changes to be disposed between the output end OP1 and the voltage source VDD, the switch SW4 changes to be disposed between the output end ON1 and the voltage source VMID, the switch SW7 changes to be disposed between the output end OP2 and the voltage source VMID, and the switch SW8 changes to be disposed between the output end ON2 and ground GND in the driving module 40. The driving module 40 further adds switches SW9, SW10, diodes DIO1 and DIO2 in the driving units 102 and 104, respectively. The switch SW9 is coupled between the cathode of the diode DIO1 and the output end OUTP, the anode of the diode DIO1 is coupled to the voltage source VMID, the switch SW10 is coupled between the anode of the diode DIO2 and the output end OUTN, and the cathode of the diode DIO2 is coupled to the voltage source VMID.

When the polarity signal POL indicates that the display system performs the polarity inversion, the control unit 100 generates the control signal for disconnecting the switches SW1, SW2, SW5 and SW6 and conducting the switches SW3, SW4, SW7-SW10 for the certain period. Within the certain period, the transistors MP1, MN1, MP2 and MN2 are all in the cut-off state, the output end OUTP is charged by the voltage source VMID via the diode DIO1 and the output end OUTN is discharged by the voltage source VMID via the diode VMID. As a result, the amount of charges of the voltage source VDD charging the output end OUTP and ground GND discharging the output end OUTN is reduced, so as to decrease the average power consumption of the driving module 40.

Figure 5:
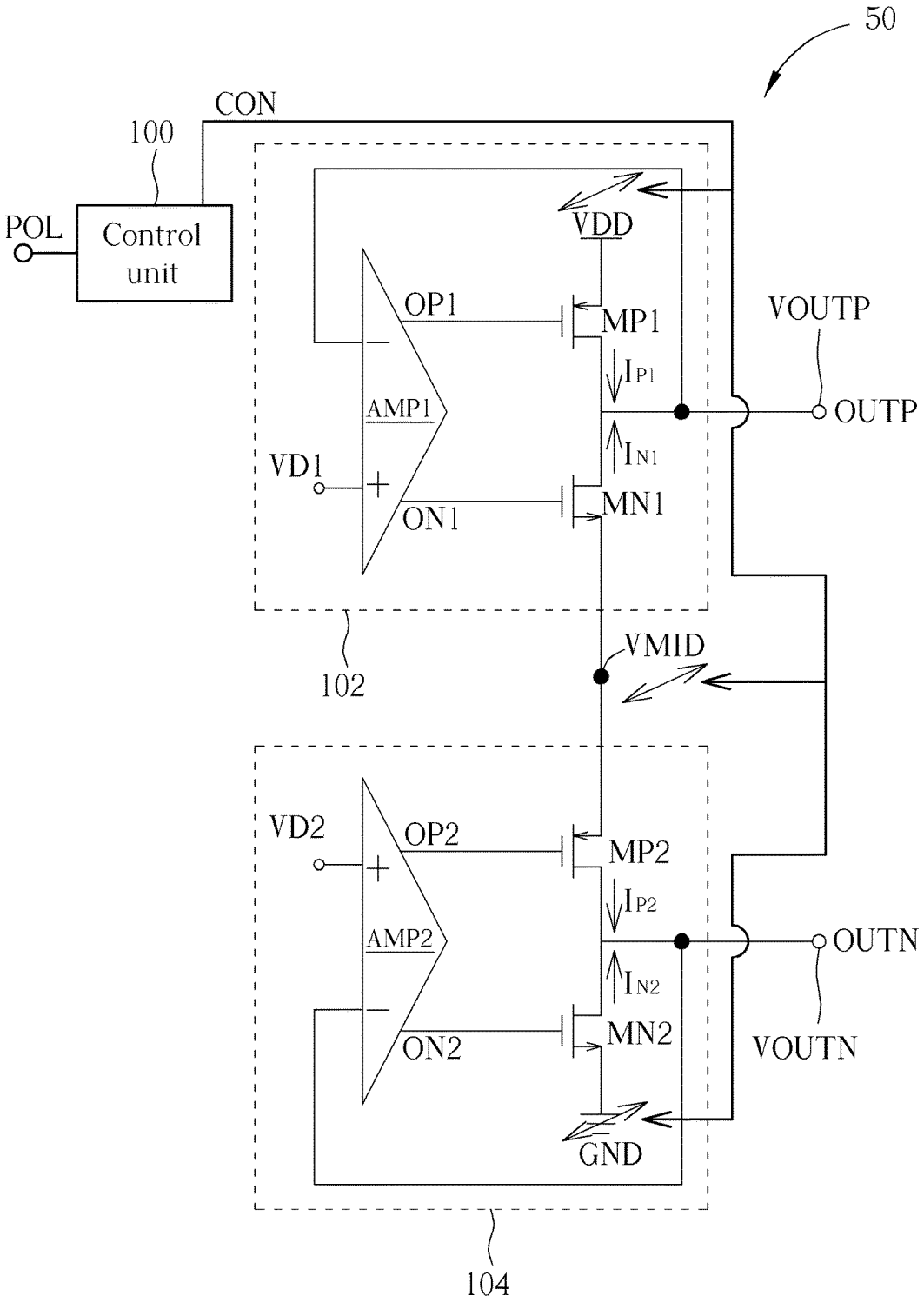
FIG. 5 is a schematic diagram of a driving module according to still another embodiment of the present invention.
Figure 6:
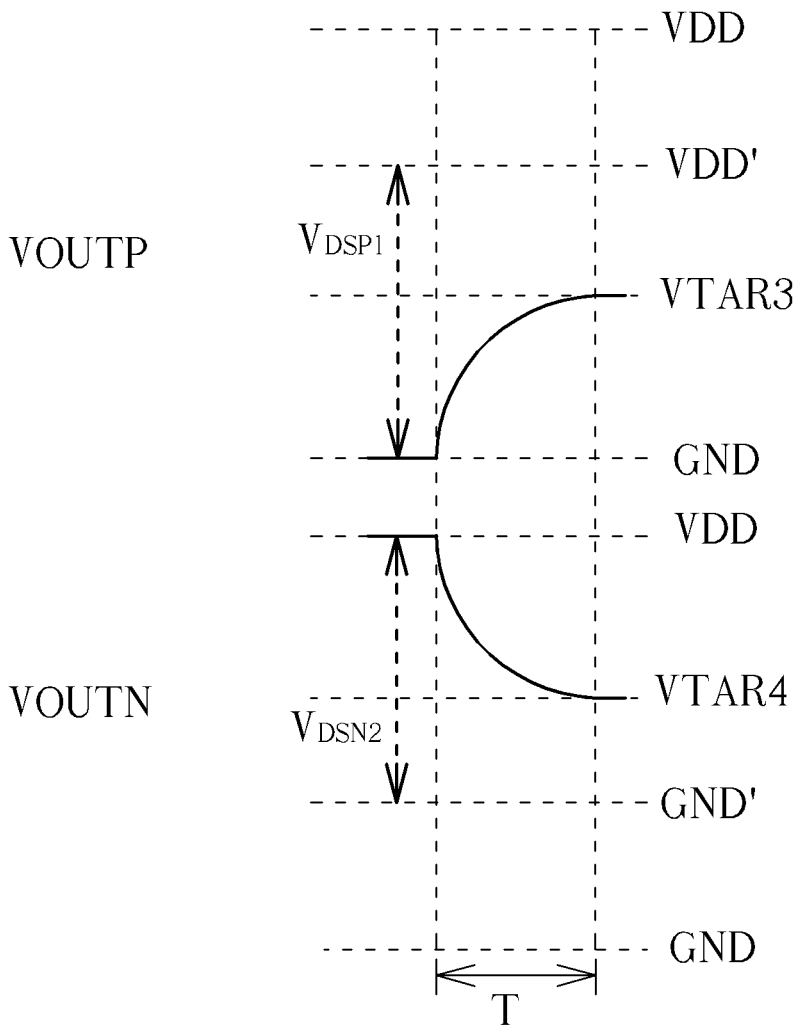
FIG. 6 is a timing diagram of related signals when the driving module shown in FIG. 5 performs the polarity inversion.

Please refer to FIG. 5, which is a schematic diagram of a driving module 50 according to an embodiment of the present invention. The driving module 50 is similar to the driving module 10 shown in FIG. 1; thus, the components and the signals with the similar functions use the same symbols. The driving module 50 is utilized in a driving device of a display system for generating the output voltages VOUTP and VOUTN used for driving display components, such as liquid crystal molecules, of the display system. For example, the driving module 50 may be a source driver and the driving device may comprise a plurality of driving modules 50 for generating signals for driving a plurality of data lines of the display system. In comparison with the driving module 10, the switches SW1-SW8 are removed and the output ends OP1, ON1, OP2, and ON2 are coupled to the gates of the transistors MP1, MN1, MP2 and MN2, respectively. The transistor MP1 can be regarded as the switch coupled between the voltage source VDD and the output end OUTP and controlled by the control signal UP1. The transistor MN1 can be regarded as the switch coupled between the voltage source VMID and the output end OUTP and controlled by the control signal DN1. The transistor MP2 can be regarded as the switch coupled between the voltage source VMID and the output end OUTN and controlled by the control signal UP2. The transistor MN2 can be regarded as the switch coupled between the ground and the output end OUTN and controlled by the control signal DN2. The control unit 100 may receive a charging-discharging signal CDS (e.g. the polarity signal POL), which indicates that the timings of the voltage source VDD charging the output end OUTP via the transistor MP1, the voltage source VMID discharging the output end OUTP via the transistor MN1, the voltage source VMID charging the output end OUTN via the transistor MP2 and the ground GND discharging the output end OUTN via the transistor MN2 according to the polarity signal POL. According to the charging-discharging signal CDS, the control unit 100 adjusts the voltages of the voltage sources VDD, VMID and ground GND. The voltage differences of charging/discharging the output end OUTP and charging/discharging the output end OUTN is therefore reduced Please refer to FIG. 6, which is a timing diagram of related signals when the driving module 60 performs the polarity inversion. As shown in FIG. 6, when the polarity inversion is performed, the output voltage VOUTP is desired to be increased to a target voltage VTAR3, which is greater than the voltage of the voltage source VMID, and the output voltage VOUTN is desired to be decreased to a target voltage VTAR4, which is smaller than the voltage of the voltage source VMID, in the period T. Within the period T, the voltage of the voltage source VDD is decreased to a voltage VDD', which is greater than the target voltage VTAR3. The voltage difference of charging the output end OUTP (i.e. the voltage difference across the drain and the source of the transistor MP1) is therefore reduced, so as to decrease the power consumption of the driving module 50. Similarly, the voltage of ground GND is increased to a voltage GND', which is smaller than the target voltage VTAR4. The voltage difference of discharging the output end OUTN (i.e. the voltage difference across the drain and the source of the transistor MN2) is therefore reduced, so as to decrease the power consumption of the driving module 50.

Figure 7:
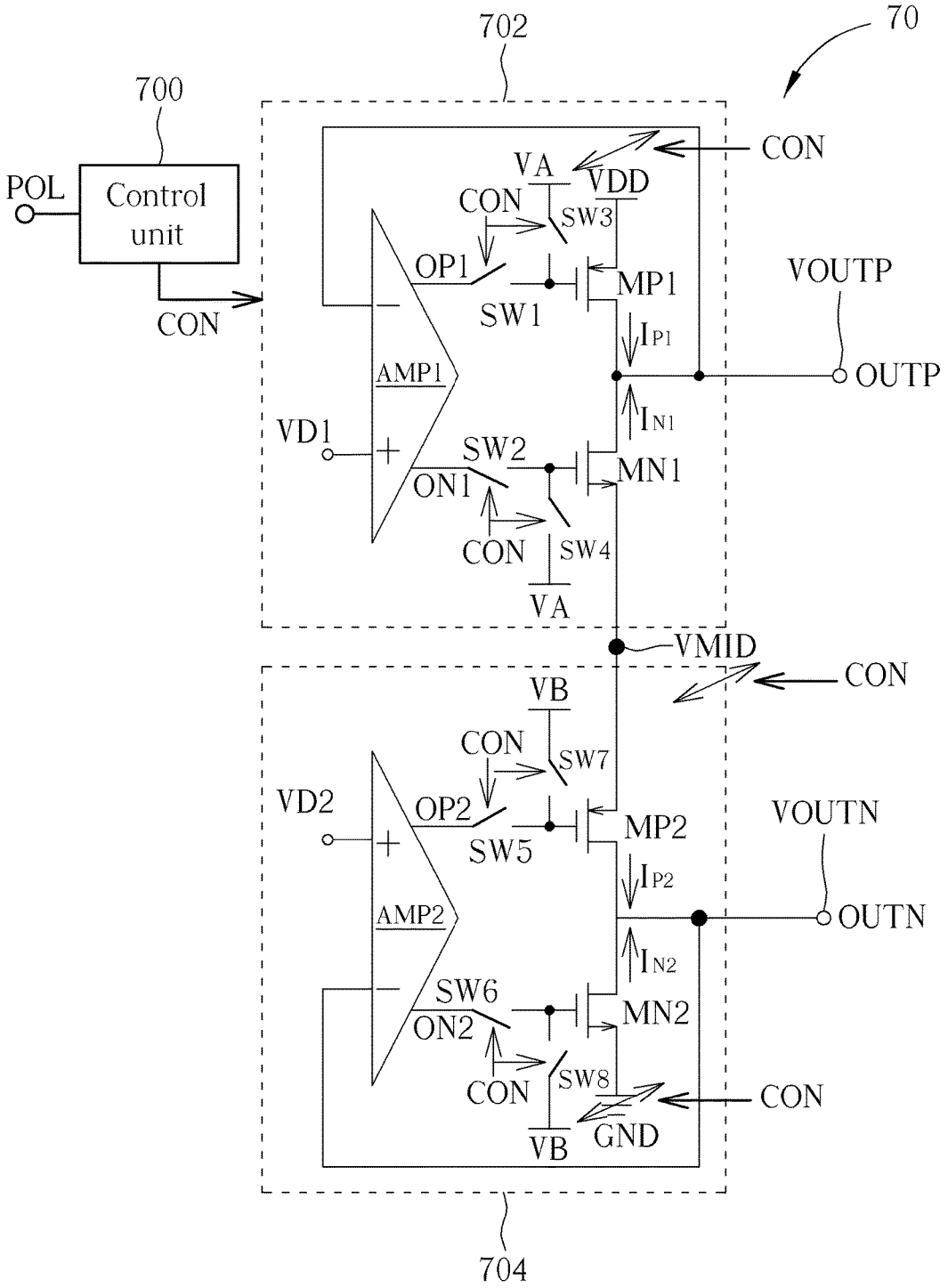
FIG. 7 is a schematic diagram of a driving module according to an embodiment of the present invention

Please refer to FIG. 7, which is a schematic diagram of a driving module 70 according to an embodiment of the present invention. The driving module 70 is similar to the driving module 10 shown in FIG. 1; thus, the components and the signals with the similar functions use the same symbols. The driving module 70 is utilized in a driving device of a display system for generating the output voltages VOUTP and VOUTN used for driving display components, such as liquid crystal molecules, of the display system. For example, the driving module 70 may be a source driver and the driving device may comprise a plurality of driving modules 70 for generating signals for driving a plurality of data lines of the display system. In this embodiment, the control signal CON is not only used for switching the switches SW1-SW8, but also used for adjusting the voltages of the voltage sources VDD, VMID and ground GND. Similar to the driving module 10, the switches SW1, SW2, SW5 and SW6 are conducted and the switches SW3, SW4, SW7 and SW8 are disconnected by the control signal CON when the polarity signal POL indicates that the driving module 10 performs normal operations. When the polarity signal POL indicates that the display system is going to perform the polarity inversion, the switches SW1, SW2, SW5 and SW6 are disconnected and the switches SW3, SW4, SW7 and SW8 for are conducted for certain period by the control signal CON. In this embodiment, the control signal CON further adjusts the voltages of the voltages of the voltage sources VDD, VMID and ground GND in the certain period, to decrease the drain-source voltages of charging and discharging the output ends OUTP and OUTN, so as to reduce the power consumption of the driving module 70.

Figure 8A:
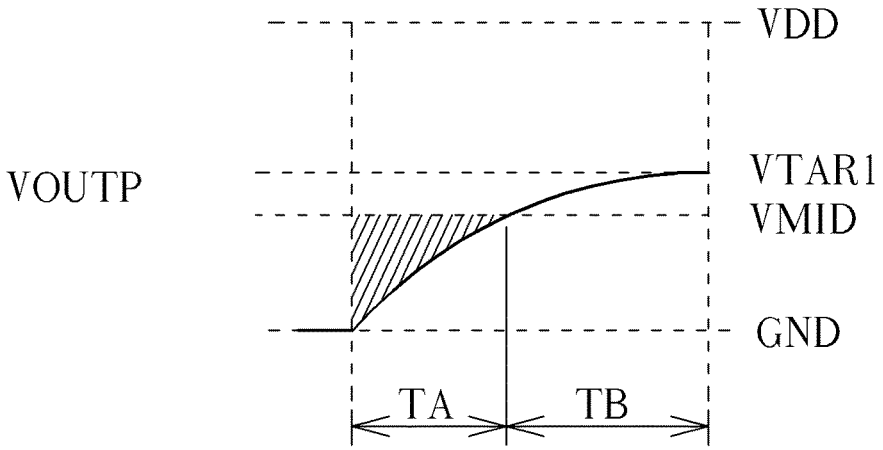
FIGS. 8A and 8B are timing diagrams of the related signals when the driving module 70 shown in FIG. 7 operates.
Figure 8B:
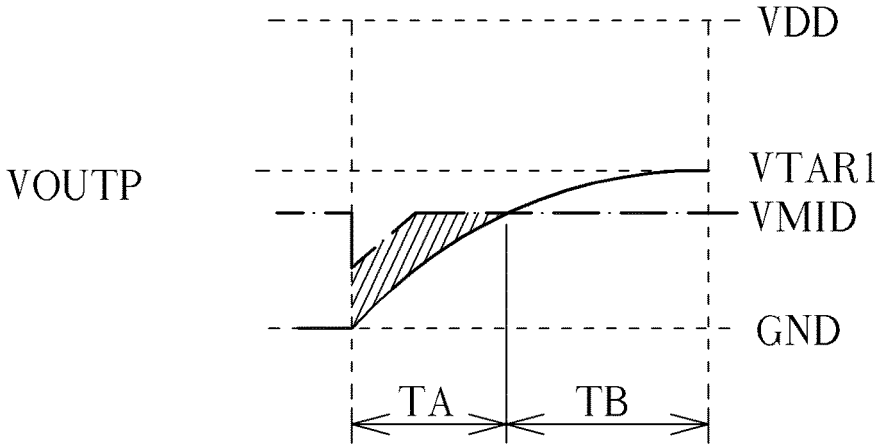

Please refer to FIGS. 8A and 8B, which are timing diagrams of the related signals when the driving module 70 shown in FIG. 7 operates. In FIGS. 8A and 8B, the output end OUTP is charged by the voltage source VMID within the period TA and is charged by the voltage source VDD within the period TB. As shown in FIG. 8A, the voltage source VMID keeps the same in the period TA and the charges consuming for charging the output end OUTP from the voltage source VMID is equal to the hatched area shown in FIG. 8A. In comparison, the voltage source VMID is decreased at the beginning of the period TA and is gradually increased in the period TA. In such a condition, the charges consuming for charging the output end OUTP from the voltage source VMID is equal to the hatched area shown in FIG. 8B. As can be seen from FIGS. 8A and 8B, the charges of charging the output end OUTP from the voltage source VMID can be decreased if the voltage of the voltage source VMID is appropriately adjusted. According to different design concepts, the voltage of the voltage source VMID also can be increased when the control signal CON instructs discharging the output end OUTP to the voltage source VMID, to decrease the power consumption of discharging the output end OUTP. Via transiently adjusting the voltages of the voltage sources VDD, VMID and the ground GND, the power consumption of the driving module 70 can be reduced.

To sum up, the driving modules in the above embodiments reduce the power consumption via decreasing the voltage differences of charging and discharging operations when performing the polarity inversion. Therefore, the temperature of the driving device and the display system is prevented from being increased and the reliability of the driving device is improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving module for a driving device of a display system, comprising:

a control unit, for generating a control signal according to a polarity signal indicating whether the driving device performs a polarity inversion;

a first driving unit, coupled to the control unit, a first voltage source and a second voltage source, for generating a positive output voltage at a first output end according to a first display voltage and charging the first output end via the second voltage source according to the control signal; and a second driving unit, coupled to the control unit, the second voltage source and a third voltage source, for generating a negative output voltage at a second output end according to a second display voltage and discharging the second output end via the second voltage source according to the control signal.

2. The driving module of claim 1, wherein the first driving unit charges the first output end via the second voltage source and the second driving unit discharges the second output end via the second voltage source for a period when the polarity signal indicates that the driving device performs the polarity inversion.

3. The driving module of claim 1, wherein the first driving unit comprises:

an amplifier, comprising a positive input end coupled to the first display voltage, a negative input end coupled to the first output end, a positive output end and a negative output end, for generating a positive control signal at the positive output end and a negative control signal at the negative output end according to the first display voltage;

a first switch, coupled between a first node and the positive output end for switching a first connection between the first node and the positive output end according to the control signal;

a second switch, coupled between a second node and the negative output end for switching a second connection from a second node and the negative output end according to the control signal;

a third switch, coupled between the first node and a fourth voltage source for switching a third connection between the first node and the fourth voltage source according to the control signal;

a fourth switch, coupled between the second node and the fourth voltage source for switching a fourth connection between the second node and the fourth voltage source according to the control signal;

a first transistor, comprising a first end coupled to the first output end, a second end coupled to the first node, a third end coupled to the first voltage source; and a second transistor, comprising a fourth end coupled to the first output end, a fifth end coupled to the second node and a sixth end coupled to the second voltage source;

wherein the voltage difference between the voltages of the first voltage source and the fourth voltage source disconnects the first transistor and the voltage difference between the voltages of the second voltage source and the fourth voltage source conducts the second transistor.

4. The driving module of claim 1, wherein the second driving unit comprises:

an amplifier, comprising a positive input end coupled to the second display voltage, a negative input end coupled to the second output end, a positive output end and a negative output end, for generating a positive control signal at the positive output end and a negative control signal at the negative output end according to the second display voltage;

a first switch, coupled between a first node and the positive output end for switching a first connection between the first node and the positive output end according to the control signal;

a second switch, coupled between a second node and the negative output end for switching a second connection from a second node and the negative output end according to the control signal;

a third switch, coupled between the first node and a fourth voltage source for switching a third connection between the first node and the fourth voltage source according to the control signal;

a fourth switch, coupled between the second node and the fourth voltage source for switching a fourth connection between the second node and the fourth voltage source according to the control signal;

a first transistor, comprising a first end coupled to the second output end, a second end coupled to the first node, a third end coupled to the second voltage source; and a second transistor, comprising a fourth end coupled to the second output end, a fifth end coupled to the second node and a sixth end coupled to the third voltage source;

wherein the voltage difference between the voltages of the second voltage source and the fourth voltage source conducts the first transistor and the voltage difference between the voltages of the third voltage source and the fourth voltage source disconnects the second transistor.

5. The driving module of claim 1, wherein the first driving unit comprises:

an amplifier, comprising a positive input end coupled to the first display voltage, a negative input end coupled to the first output end, a positive output end and a negative output end, for generating a positive control signal at the positive output end and a negative control signal at the negative output end according to the first display voltage;

a first switch, coupled between a first node and the positive output end for controlling a first connection between the first node and the positive output end according to the control signal;

a second switch, coupled between a second node and the positive output end for controlling a second connection between the second node and the negative output end according to the control signal;

a third switch, coupled between the first node and the first voltage source for controlling a third connection between the first node and the first voltage source according to the control signal;

a fourth switch, coupled between the second node and the second voltage source for controlling a fourth connection between the second node and the second voltage source according to the control signal;

a first transistor, comprising a first end coupled to the first output end, a second end coupled to the first node, a third end coupled to the first voltage source;

a second transistor, comprising a fourth end coupled to the first output end, a fifth end coupled to the second node and a sixth end coupled to the second voltage source;

a fifth switch, coupled between a third node and the first output end for controlling a fifth connection between the first output end and the third node according to the control signal; and a diode, comprising an anode coupled to the second voltage source and a cathode coupled to the third node.

6. The driving module of claim 1, wherein the second driving unit comprises:

an amplifier, comprising a positive input end coupled to the second display voltage, a negative input end coupled to the second output end, a positive output end and a negative output end, for generating a positive control signal at the positive output end and a negative control signal at the negative output end according to the second display voltage;

a first switch, coupled between a first node and the positive output end for controlling a first connection between the first node and the positive output end according to the control signal;

a second switch, coupled between a second node and the positive output end for controlling a second connection between the second node and the negative output end according to the control signal;

a third switch, coupled between the first node and the second voltage source for controlling a third connection between the first node and the second voltage source according to the control signal;

a fourth switch, coupled between the second node and the third voltage source for controlling a fourth connection between the second node and the third voltage source according to the control signal;

a first transistor, comprising a first end coupled to the second output end, a second end coupled to the first node, a third end coupled to the second voltage source;

a second transistor, comprising a fourth end coupled to the second output end, a fifth end coupled to the second node and a sixth end coupled to the third voltage source;

a fifth switch, coupled between a third node and the second output end for controlling a fifth connection between the second output end and the third node according to the control signal; and a diode, comprising an anode coupled to the third node and a cathode coupled to the second voltage source.

7. A driving device for a display system, comprising:

a plurality of display component, drove by a plurality of driving signals; and a plurality of driving modules, for generating the plurality of the driving signals, wherein each of the driving modules comprises:

a control unit, for generating a control signal according to a polarity signal indicating whether the driving device performs a polarity inversion;

a first driving unit, coupled to the control unit, a first voltage source and a second voltage source, for generating a positive output voltage at a first output end according to a first display voltage and charging the first output end via the second voltage source according to the control signal; and a second driving unit, coupled to the control unit, the second voltage source and a third voltage source, for generating a negative output voltage at a second output end according to a second display voltage and discharging the second output end via the second voltage source according to the control signal.

8. The driving device of claim 7, wherein the first driving unit charges the first output end via the second voltage source and the second driving unit discharges the second output end via the second voltage source for a period when the polarity signal indicates that the driving device performs the polarity inversion.

9. The driving device of claim 7, wherein the first driving unit comprises:

an amplifier, comprising a positive input end coupled to the first display voltage, a negative input end coupled to the first output end, a positive output end and a negative output end, for generating a positive control signal at the positive output end and a negative control signal at the negative output end according to the first display voltage;

a first switch, coupled between a first node and the positive output end for switching a first connection between the first node and the positive output end according to the control signal;

a second switch, coupled between a second node and the negative output end for switching a second connection from a second node and the negative output end according to the control signal;

a third switch, coupled between the first node and a fourth voltage source for switching a third connection between the first node and the fourth voltage source according to the control signal;

a fourth switch, coupled between the second node and the fourth voltage source for switching a fourth connection between the second node and the fourth voltage source according to the control signal;

a first transistor, comprising a first end coupled to the first output end, a second end coupled to the first node, a third end coupled to the first voltage source; and a second transistor, comprising a fourth end coupled to the first output end, a fifth end coupled to the second node and a sixth end coupled to the second voltage source;

wherein the voltage difference between the voltages of the first voltage source and the fourth voltage source disconnects the first transistor and the voltage difference between the voltages of the second voltage source and the fourth voltage source conducts the second transistor.

10. The driving device of claim 7, wherein the second driving unit comprises:

an amplifier, comprising a positive input end coupled to the second display voltage, a negative input end coupled to the second output end, a positive output end and a negative output end, for generating a positive control signal at the positive output end and a negative control signal at the negative output end according to the second display voltage;

a first switch, coupled between a first node and the positive output end for switching a first connection between the first node and the positive output end according to the control signal;

a second switch, coupled between a second node and the negative output end for switching a second connection from a second node and the negative output end according to the control signal;

a third switch, coupled between the first node and a fourth voltage source for switching a third connection between the first node and the fourth voltage source according to the control signal;

a fourth switch, coupled between the second node and the fourth voltage source for switching a fourth connection between the second node and the fourth voltage source according to the control signal;

a first transistor, comprising a first end coupled to the second output end, a second end coupled to the first node, a third end coupled to the second voltage source; and a second transistor, comprising a fourth end coupled to the second output end, a fifth end coupled to the second node and a sixth end coupled to the third voltage source;

wherein the voltage difference between the voltages of the second voltage source and the fourth voltage source conducts the first transistor and the voltage difference between the voltages of the third voltage source and the fourth voltage source disconnects the second transistor.

11. The driving device of claim 7, wherein the first driving unit comprises:

an amplifier, comprising a positive input end coupled to the first display voltage, a negative input end coupled to the first output end, a positive output end and a negative output end, for generating a positive control signal at the positive output end and a negative control signal at the negative output end according to the first display voltage;

a first switch, coupled between a first node and the positive output end for controlling a first connection between the first node and the positive output end according to the control signal;

a second switch, coupled between a second node and the positive output end for controlling a second connection between the second node and the negative output end according to the control signal;

a third switch, coupled between the first node and the first voltage source for controlling a third connection between the first node and the first voltage source according to the control signal;

a fourth switch, coupled between the second node and the second voltage source for controlling a fourth connection between the second node and the second voltage source according to the control signal;

a first transistor, comprising a first end coupled to the first output end, a second end coupled to the first node, a third end coupled to the first voltage source;

a second transistor, comprising a fourth end coupled to the first output end, a fifth end coupled to the second node and a sixth end coupled to the second voltage source;

a fifth switch, coupled between a third node and the first output end for controlling a fifth connection between the first output end and the third node according to the control signal; and a diode, comprising an anode coupled to the second voltage source and a cathode coupled to the third node.

12. The driving device of claim 7, wherein the second driving unit comprises:

an amplifier, comprising a positive input end coupled to the second display voltage, a negative input end coupled to the second output end, a positive output end and a negative output end, for generating a positive control signal at the positive output end and a negative control signal at the negative output end according to the second display voltage;

a first switch, coupled between a first node and the positive output end for controlling a first connection between the first node and the positive output end according to the control signal;

a second switch, coupled between a second node and the positive output end for controlling a second connection between the second node and the negative output end according to the control signal;

a third switch, coupled between the first node and the second voltage source for controlling a third connection between the first node and the second voltage source according to the control signal;

a fourth switch, coupled between the second node and the third voltage source for controlling a fourth connection between the second node and the third voltage source according to the control signal;

a first transistor, comprising a first end coupled to the second output end, a second end coupled to the first node, a third end coupled to the second voltage source;

a second transistor, comprising a fourth end coupled to the second output end, a fifth end coupled to the second node and a sixth end coupled to the third voltage source;

a fifth switch, coupled between a third node and the second output end for controlling a fifth connection between the second output end and the third node according to the control signal; and a diode, comprising an anode coupled to the third node and a cathode coupled to the second voltage source.

13. A driving module for a driving device of a display system, comprising:

a first amplifier, comprising a first positive input end coupled to a first display voltage, a first negative input end coupled to a first output end, a first positive output end and a first negative output end, for generating a first positive control signal at the first positive output end and a first negative control signal at the first negative output end according to the first display voltage;

a second amplifier, comprising a second positive input end coupled to a second display voltage, a second negative input end coupled to a second output end, a second positive output end and a second negative output end, for generating a second positive control signal at the second positive output end and a second negative control signal at the second negative output end according to the second display voltage;

a first switch, coupled to the first positive output end of the first amplifier, a first voltage source and a first output end for controlling the connection between the first voltage source and the first output end according to the first positive control signal;

a second switch, coupled to the first negative output end of the first amplifier, a second voltage source and the first output end for controlling the connection between the second voltage source and the first output end according to the first negative control signal;

a third switch, coupled to the second positive output end of the second amplifier, the second voltage source and the second output end for controlling the connection between a second voltage source and the second output end according to the second positive control signal;

a fourth switch, coupled to the second amplifier, a third voltage source and the second output end for controlling the connection between the third voltage source and the second output end according to the second negative control signal; and a control unit, for adjusting voltages of the first voltage source, the second voltage source and the third voltage source according to a charging-discharging signal indicating timings that the first voltage source charging the first output end via the first switch, the second voltage source discharging the first output end via the second switch, the second voltage source charging the second output end via the third switch and the third voltage source discharging the second output end via the fourth switch.

14. The driving module of claim 13, wherein the control unit adjusts the voltage of the first voltage source to a mid-voltage within the voltages of the first voltage source and the second voltage source for a period when the charging-discharging signal indicates that the first voltage source charges the first output end via the first switch.

15. The driving module of claim 13, wherein the control unit adjusts the voltage of the second voltage source to a mid-voltage within the voltages of the first voltage source and the second voltage source for a period when the charging-discharging signal indicates that the second voltage source discharges the first output end via the second switch.

16. The driving module of claim 13, wherein the control unit adjusts the voltage of the second voltage source to a mid-voltage within the voltages of the second voltage source and the third voltage source for a period when the charging-discharging signal indicates that the second voltage source charges the second output end via the third switch.

17. The driving module of claim 13, wherein the control unit adjusts the voltage of the third voltage source to a mid-voltage within the voltages of the second voltage source and the third voltage source for a period when the charging-discharging signal indicates that the third voltage source discharges the second output end via the fourth switch.

18. A driving device for a display system, comprising:

a plurality of display components, drove by a plurality of driving signals; and a plurality of driving modules, for generating the plurality of driving signals, wherein each of the plurality of driving modules comprises:

a first amplifier, comprising a first positive input end coupled to a first display voltage, a first negative input end coupled to a first output end, a first positive output end and a first negative output end, for generating a first positive control signal at the first positive output end and a first negative control signal at the first negative output end according to the first display voltage;

a second amplifier, comprising a second positive input end coupled to a second display voltage, a second negative input end coupled to a second output end, a second positive output end and a second negative output end, for generating a second positive control signal at the second positive output end and a second negative control signal at the second negative output end according to the second display voltage;

a first switch, coupled to the first positive output end of the first amplifier, a first voltage source and a first output end for controlling the connection between the first voltage source and the first output end according to the first positive control signal;

a second switch, coupled to the first negative output end of the first amplifier, a second voltage source and the first output end for controlling the connection between the second voltage source and the first output end according to the first negative control signal;

a third switch, coupled to the second positive output end of the second amplifier, the second voltage source and the second output end for controlling the connection between a second voltage source and the second output end according to the second positive control signal;

a fourth switch, coupled to the second amplifier, a third voltage source and the second output end for controlling the connection between the third voltage source and the second output end according to the second negative control signal; and a control unit, for adjusting voltages of the first voltage source, the second voltage source and the third voltage source according to a charging-discharging signal indicating timings that the first voltage source charging the first output end via the first switch, the second voltage source discharging the first output end via the second switch, the second voltage source charging the second output end via the third switch and the third voltage source discharging the second output end via the fourth switch.

19. The driving device of claim 18, wherein the control unit adjusts the voltage of the first voltage source to a mid-voltage within the voltages of the first voltage source and the second voltage source for a period when the charging-discharging signal indicates that the first voltage source charges the first output end via the first switch.

20. The driving device of claim 18, wherein the control unit adjusts the voltage of the second voltage source to a mid-voltage within the voltages of the first voltage source and the second voltage source for a period when the charging-discharging signal indicates that the second voltage source discharges the first output end via the second switch.

21. The driving device of claim 18, wherein the control unit adjusts the voltage of the second voltage source to a mid-voltage within the voltages of the second voltage source and the third voltage source for a period when the charging-discharging signal indicates that the second voltage source charges the second output end via the third switch.

22. The driving device of claim 18, wherein the control unit adjusts the voltage of the third voltage source to a mid-voltage within the voltages of the second voltage source and the third voltage source for a period when the charging-discharging signal indicates that the third voltage source discharges the second output end via the fourth switch.

* * * * *